US005386937A

United States Patent [19]

Crawford

[11] Patent Number: 5,386,937

[45] Date of Patent: Feb. 7, 1995

[54] CARTON FOR HOUSING NAILS AND LIKE SHARP OBJECTS

[75] Inventor: Darwin L. Crawford, Newberry, S.C.

[73] Assignee: Packaging Corporation of America, Evanston, Ill.

[21] Appl. No.: 29,353

[22] Filed: Mar. 4, 1993

Related U.S. Application Data

[63] Continuation of Ser. No. 862,321, Apr. 2, 1992, abandoned.

[51] Int. Cl.[6] ..... B65D 5/08

[52] U.S. Cl. ..... 229/138; 229/930; 229/931

[58] Field of Search ..... 229/137, 138, DIG. 4, 229/133

[56] References Cited

U.S. PATENT DOCUMENTS

| | | | |
|---|---|---|---|
| 339,147 | 4/1886 | Carpenter | 229/138 |
| 630,789 | 8/1899 | Wyman | 229/137 |
| 634,645 | 10/1899 | Knobeloch | 229/138 |
| 1,699,008 | 1/1929 | Miller | 229/DIG. 4 |
| 1,771,760 | 7/1930 | MacLellan | 229/DIG. 4 |
| 1,772,106 | 8/1930 | Miller | 229/DIG. 4 |
| 1,987,647 | 1/1935 | Wellman | 229/137 |
| 2,439,435 | 4/1948 | Richardson et al. | 229/137 |
| 2,799,442 | 7/1957 | Van Rosen | 229/138 |
| 2,810,506 | 10/1957 | Kessler | 229/138 |
| 3,176,904 | 4/1965 | Collura | 229/137 |
| 3,229,890 | 1/1966 | Wright | 229/137 |
| 3,248,039 | 4/1966 | Locke | 229/137 |
| 3,581,977 | 6/1971 | Kirsky et al. | 229/138 |
| 4,185,767 | 1/1980 | Sykora et al. | 229/138 |
| 5,042,684 | 8/1991 | West et al. | 229/133 |

*Primary Examiner*—Gary E. Elkins
*Attorney, Agent, or Firm*—Arnold, White & Durkee

[57] ABSTRACT

A carton for housing nails and like sharp objects is provided which includes a top side defined by opposing pairs of closure flaps and including associated minor flaps which extend outwardly and cooperate with adjacent outwardly extending closure flaps when the carton is in its open position so as to effectively extend the depth of the carton by a predetermined amount. The minor flaps are integrally defined with lines of weakness whereby the flaps can be folded inwardly with respect to the associated closure flaps when the carton is in its closed position so that the top side is defined as a smooth surface by the mutual engagement of adjacent closure flaps without being obstructed by the minor flaps.

3 Claims, 5 Drawing Sheets

CARTON FOR HOUSING NAILS AND LIKE SHARP OBJECTS

This application is a continuation of application Ser. No. 07/862,321, filed Apr. 2, 1992, now abandoned.

BACKGROUND OF THE INVENTION

1. Field of the Invention

The present invention generally relates to cartons and like containers commonly used for storage and shipment purposes. More specifically, this invention relates to an improved paperboard carton adapted to efficiently housing projecting objects such as nails and the like.

2. Description of the Prior Art

A variety of paperboard or cardboard containers are commercially available for use with storage and shipment applications. Such cartons are generally formed from corresponding panels and flaps defined on unitary carton blanks of corrugated paperboard or like material. The blank is designed in such a way that the panels and flaps comprising the blank can be folded into mutual engagement in order to define opposing pairs of top/-bottom walls and side walls which effectively define the requisite containment and closure.

Typically, at least the top side of the carton is defined by closure flaps which extend from corresponding edges of the side walls. The closure flaps extend outwardly from corresponding side walls when the carton is in an open position to define the opening through which the carton is filled with the objects to be contained therein. When the box is closed, the closure flaps are adapted to be folded down into inter-engagement with each other in order to define the top wall of the box which effectively functions as the means for containment purposes.

While paperboard cartons of the above-noted conventional type are satisfactory for most storage and shipment applications wherein the contained objects or material are fairly standard and uniform, such boxes are problematic when used for housing sharp projecting objects such as nails and the like. With particular reference to packaging of nails, for instance, conventional paperboard cartons are incapable of efficiently containing nails without at least some nails protruding or jutting out of the carton corners as the cartons undergo the automatic filling process.

More specifically, in applications where nails are packaged in bulk quantities, paperboard cartons used for housing the nails are first automatically erected from corresponding unitary carton blanks. The cartons are bottom-sealed with appropriate adhesive means such as tape and transported by conveyor means into a loading position where the top wall of the carton is maintained in an open position with the closure flaps extending outwardly. In the loading position, the open carton is filled by dumping a predefined quantity (generally, in terms of weight) of nails into the carton.

With conventional cartons, the dumping of nails generally results in the carton being filled with nails beyond or above the standard depth of the carton as defined by the height of the carton side walls. As a result, it is common for at least some nails to become trapped within the carton slots or corners defined between adjacent surface edges of the closure flaps which define the top wall of the carton. Although it is conventional to subject such filled cartons to an agitating action using an industrial vibrating table in order to settle contained nails to the proper carton depth, it is not practically possible to remove or dislodge all nails which get trapped about the carton slots or corners. As a result, when such a carton is passed through an automatic case sealer where the closure flaps are folded down and taped over, the final packaged carton generally includes several nail points protruding outwardly of the carton corners.

There, accordingly, exists a distinct need for a paperboard carton which avoids the above-noted problems with conventional carton designs in applications requiring effective containment of sharp objects such as nails.

SUMMARY OF THE INVENTION

In view of the foregoing, it is a principal object of the present invention to provide a paperboard carton which is particularly adapted for effectively containing sharp projecting objects such as nails and the like.

It is a related object of this invention to provide such a paperboard carton which is particularly adapted to preventing outward protrusion of contained sharp objects such as nails after the carton has been automatically erected, filled and sealed.

Briefly, in accordance with the principles of the present invention, the above and other objects are realized by providing a paperboard carton which is specifically adapted for housing sharp projecting objects such as nails and comprises opposing top and bottom sides and two pairs of opposing side walls all formed from corresponding panels and flaps defined on a unitary continuous carton blank. In particular, the top side of the carton is defined by closure flaps which extend from corresponding edges of the side walls and are adapted to (i) extend outwardly from corresponding side walls when the carton is open so as to define an opening through which the carton may be filled with the nails, and (ii) be placed into mutual engagement when the box is closed so as to define the top side and contain the nails within the carton.

According to a feature of the present invention, at least one opposing pair of the closure flaps are provided with minor flap portions integral therewith. The minor flaps extend outwardly and cooperate with adjacent outwardly extending flaps when the carton is in its open position so as to effectively extend the depth of the carton by a predetermined amount. The minor flaps are defined in such a way that they fold inwardly with respect to the associated flap on which the minor flaps are defined when the carton is in its closed position. The end result is that the top side is smoothly defined by the mutual engagement of the adjacent flaps without being obstructed in any way by the minor flaps.

Preferably, the minor flap portions are provided on each end of the opposing pair of closure flaps and are connected thereto by means of an angular line of weakness whereby the minor flaps can be folded inwardly with respect to the associated flap on which the flaps are defined when the carton is closed. Also, preferably the angular line of weakness through which the minor flap portions are connected to the closure flaps is disposed at 45° with respect to the horizontal edge of the flap on which the minor flaps are defined. According to a preferred embodiment, the angular line of weakness is defined by splitting a central portion thereof and scoring end portions thereof to a predefined depth.

When the paperboard carton according to this invention is erected with the top side of the carton in its open position, the closure flaps extend outwardly, while at the same time, the minor flaps also extend outwardly and cooperate with adjacent outwardly extending flaps. As a result, the effective depth of the carton is extended by approximately the height of the minor flaps. More importantly, when the carton is closed by folding the closure flaps downwardly into mutual engagement with each other, the minor flaps also fold inwardly so that no obstruction is provided as the top side of the carton is defined by the closed flaps. At the same time, the inwardly folded flaps effectively avoid the existence of open corners or slots between adjacent closure flaps and prevent any contained nails from protruding therefrom and thereby posing a safety hazard after a carton is filled and sealed using conventional techniques.

BRIEF DESCRIPTION OF THE DRAWINGS

The invention and further objects and advantages thereof may best be understood by reference to the following description when taken in conjunction with the accompanying drawings in which.

DESCRIPTION OF THE PREFERRED EMBODIMENTS

Figure 1:
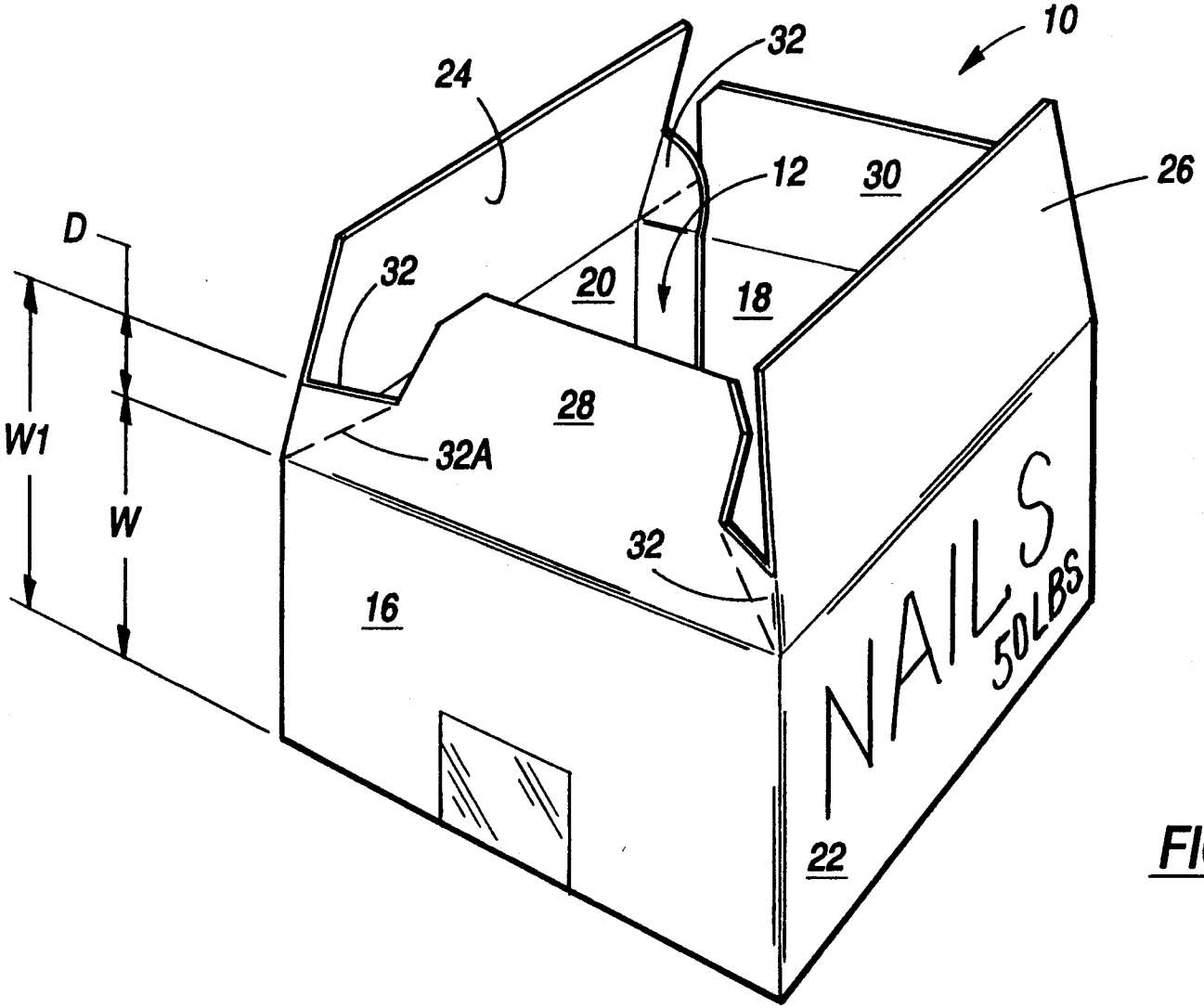
FIG. 1 is a perspective view of a paperboard carton in its open position, according to an illustrative embodiment of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

Referring now to the drawings, and particularly with reference to FIG. 1 there is shown a perspective view of a paperboard carton 10 constructed in accordance with the system of the present invention. In particular, FIG. 1 shows a paperboard carton which is a six-sided parallelopiped enclosure formed of three pairs of opposing, generally rectangular walls or panels. More specifically, the carton 10 includes opposing top and bottom sides 12 and 14, respectively, a first pair of opposing side walls 16 and 18, respectively, and a second pair of opposing side walls 20 and 22, respectively.

The top side 12 of the carton 10 is defined by opposing pairs of closure flaps which extend from corresponding top longitudinal edges of each of the side walls of the carton. In particular, opposing closure flaps 24 and 26 are respectively defined about the top edges of corresponding opposing side walls 20 and 22. Similarly, a second pair of opposing closure flaps 28 and 30 are respectively defined about the top edges of corresponding opposed end walls 16 and 18.

Figure 7:
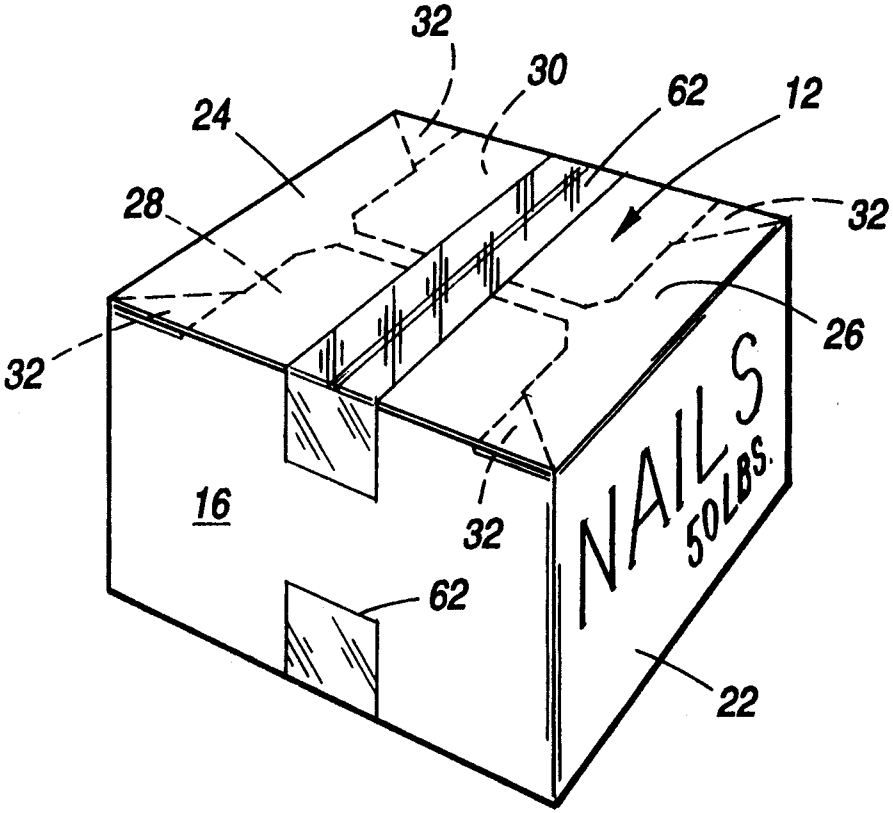
FIG. 7 is a perspective view of a paperboard carton according to the present invention after it has been erected, filled and sealed.

As seen from the illustration of FIG. 1, the closure flaps 24, 26, 28 and 30 extend outwardly from corresponding side walls when the carton 10 is in the open position shown in FIG. 1 in order to define an opening through which the carton may be filled with the objects such as nails to be contained therein. The closure flaps are adapted to be placed into mutual engagement when the carton 10 is closed so as to define the top side 12 as a smooth surface for effectively containing the nails within the carton; this aspect of the carton 10 is illustrated in FIG. 7.

Returning now to FIG. 1, the effective depth of a carton of the type shown therein corresponds to the height "W" of the side walls which define the carton. In accordance with the principles of the present invention, the effective depth of the carton 10 is increased by the provision of a plurality of minor flaps 32 which are defined about opposing closure flaps in such a way as to cover up or extend across slots or corners which would otherwise be defined between adjacent edges or surfaces of the closure flaps.

More specifically, at least one opposing pair of the closure flaps are provided with the minor flap portions 32 integral therewith. The minor flaps extend outwardly and cooperate with adjacent upwardly extending flaps when the carton is open in order to effectively extend the depth thereof by a predetermined amount "D" so as to yield an overall increased carton depth "$W_1$". The minor flaps are integrally attached to the associated closure flaps by means of lines of weakness 32A whereby the minor flaps may be folded inwardly with respect to the associated closure flaps, when the carton is in its closed position, so that the top side 12 of the carton 10 is defined as a smooth surface by the mutual engagement of adjacent closure flaps without being obstructed by the minor flaps 32.

Figure 2:
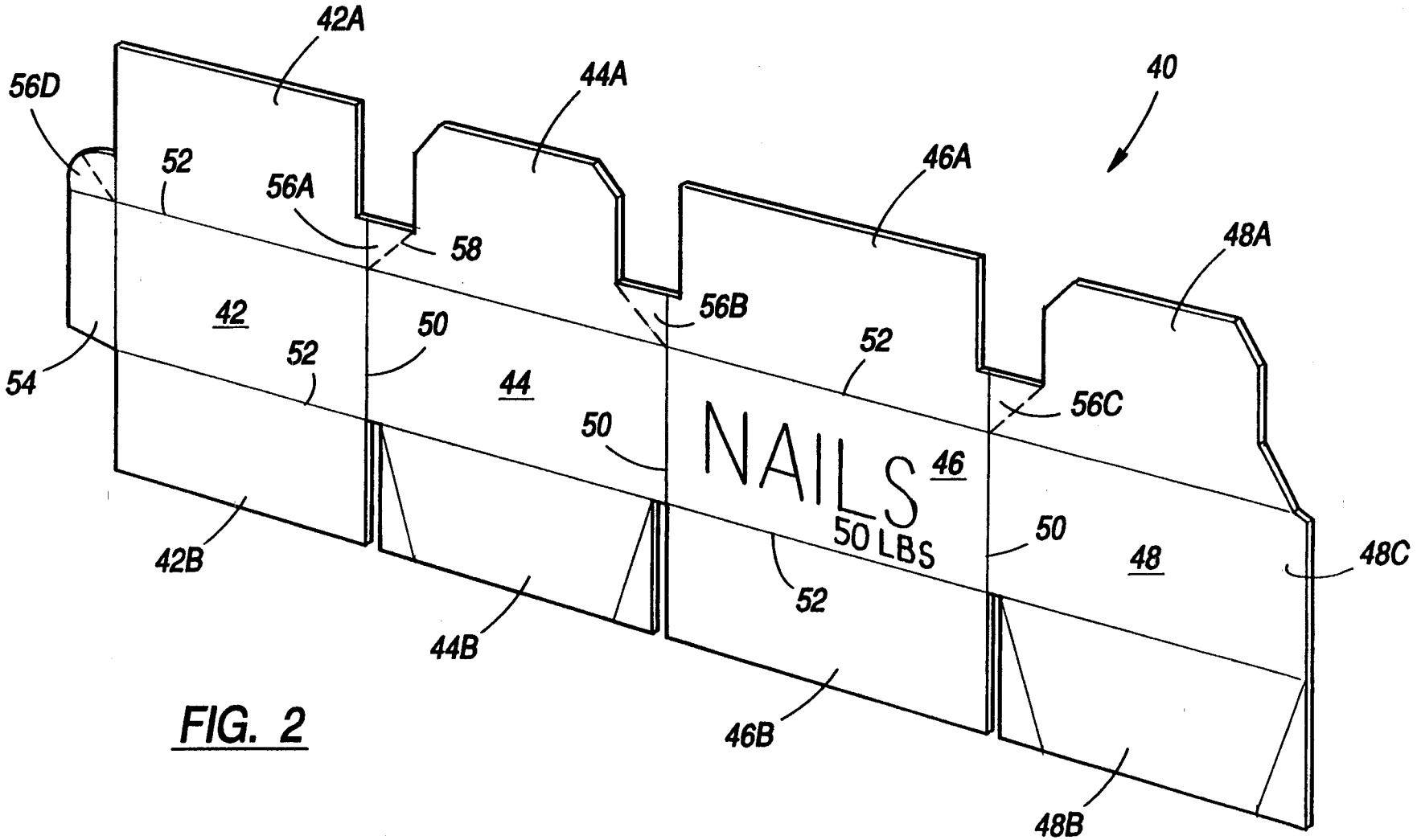
FIG. 2 is a perspective view of a carton blank corresponding to the erected carton of FIG. 1.

Referring now in particular to FIG. 2, there is illustrated a plain view of a paperboard blank used for forming a carton or container box of the type described above in connection with FIG. 1. As shown in FIG. 2, the blank 40 is in the form of a single, planar, unitary section of cardboard or paperboard which includes four horizontally aligned, substantially rectangular panels 42, 44, 46 and 48 which are linked to each other by means of vertical score lines or lines of weakness 50 which facilitate folding of the carton panels relative to each other. With respect to the manner in which these panels interact to define the erected open carton of FIG. 1 in the closed carton of FIG. 7, the panels 42 and 46 define the first pair of opposed side walls while the panels 44 and 48 define the second pair of opposed side walls, respectively.

Each of the four main panels comprising the carton blank 40 is provided with a pair of closure flaps connected along respective transverse edges thereof by means of corresponding score lines 52. More specifically, the end wall panel 42 is provided on its opposed transverse edges with a top closure flap 42A and a bottom closure flap 42B. On a similar basis, the side wall panels 44, 46 and 48 are each respectively provided with top and bottom closure flaps 44A–44B, 46A–46B and 48A–48B.

The carton blank 40 illustrated in FIG. 2 also includes a generally rectangular flap 54 horizontally aligned with the end panel 42 which is adapted to the affixed to the rear surface of the end wall panel 48 about its vertical edge 48C when the rectangular closure for the carton 10 is defined by folding the end wall panels about the lines of weakness 50. The bottom closure flaps 42B, 44B, 46B and 48B defined respectively about the end wall panels 42, 44, 46, and 48 are adapted to be placed into mutual engagement with each other in order to define the bottom side 14 of the carton 10 as a smooth enclosing surface.

Accordingly, the carton 10 shown at FIG. 1 is erected by first folding the end wall panels 42–48 relative to each other and then affixing the rectangular flap 54 over the remote edge of the panel 48 in order to define a substantially rectangular enclosure. Subsequently, the bottom closure flaps are folded inwardly with respect to the associated lines of weakness 52 and maintained in that position by use of appropriate sealing means, such as a stretch of adhesive tape 62 (see FIG. 7), in order to define the bottom side 14 of the carton 10 as a smooth surface.

Figure 4:
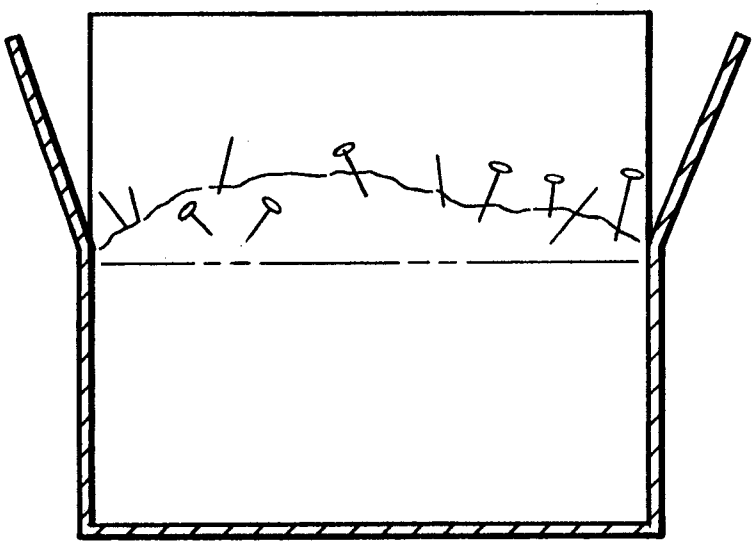
FIG. 4 is a cross-sectional illustration of a conventional paperboard carton filled with nails.
Figure 6:
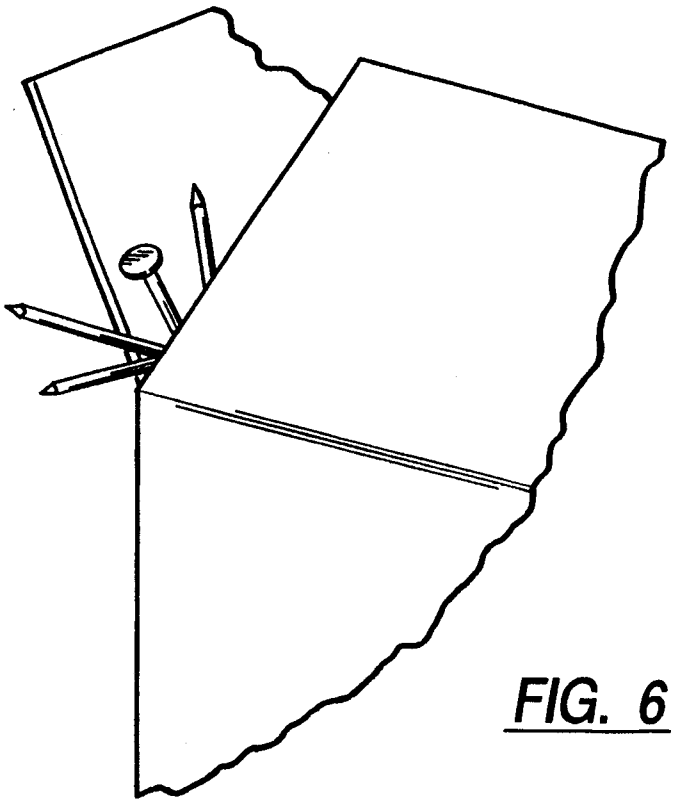
FIG. 6 is a similar sectional perspective view showing nails projecting out of the corner of a conventional carton.

In accordance with conventional carton designs, the top and bottom closure flaps are generally identical and substantially rectangular or trapezoidal in shape. When such cartons are in an open position following erection and bottom-sealing of the carton, the top closure flaps extend outwardly from corresponding side walls to define the carton opening through which the carton may be filled with nails or like objects. Under such conditions, the effective depth of the carton is equivalent to the height "W" of the opposing side walls of the carton (see FIG. 4). Consequently, when such cartons are transported into a loading position and the open carton is filled by dumping a predetermined weight of nails into the carton, the general result is that the carton is filled with nails beyond or above the effective depth W defined by the carton side walls. Under such conditions, it is common for at least some or several of the dumped nails to become trapped within the carton slots or corners defined between adjacent surface edges of the closure flaps which define the top wall of the carton (see FIG. 6).

Figure 8:
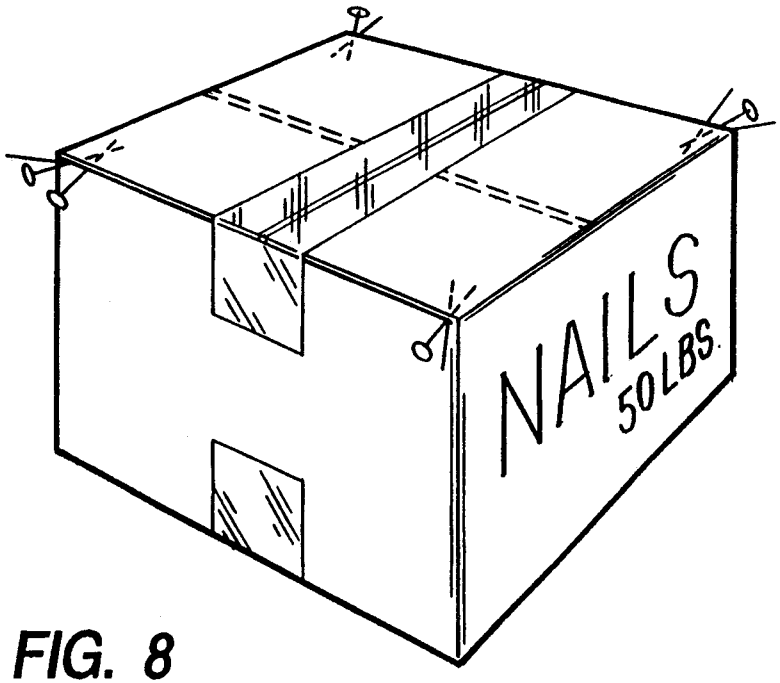
FIG. 8 is a similar perspective view showing a conventional carton in its closed position with nails contained therein.

In order to dislodge such trapped nails and better settle the dumped nails within the containing carton, it is conventional to subject filled cartons to an agitating action using an industrial vibrating table. However, even with vigorous vibrating motion, it is not practically feasible to remove or dislodge all nails which inevitably get trapped about the carton slots or corners. As a result, when such filled cartons are automatically sealed by closing the open closure flaps into mutual engagement by folding the flaps down and affixing the flaps by means of appropriate adhesive means such as a stretch of adhesive tape, it is common for the final packaged carton to include several nail points protruding outwardly of the carton corners (see FIG. 8). Accordingly, such conventional cartons are incapable of effectively avoiding the presence of open corners or slots between adjacent closure flaps and preventing contained nails from protruding outwardly of the carton and thereby posing a safety hazard after a carton has been erected, folded and sealed automatically.

Improved containment of nails and like sharp objects is realized, in accordance with an important aspect of the present invention, by the provision of the minor flaps 32 which are defined about the corners or slots otherwise existing between adjacent surface edges of the closure flaps defining the top wall of the carton. According to a feature of this invention, at least one opposing pair of the closure flaps are provided with the minor flaps 32 are integral therein. With respect to the carton blank 40 shown in FIG. 2, for instance, the top closure flap 44A is provided with integral minor flaps 56A and 56B which are defined at the transverse edges thereof about corresponding lines of weakness 58. The corresponding opposing top closure flap 48A is similarly provided with a minor flap 56C integrally linked thereto about its edge adjacent to the end panel 46A; again, the linking is through an associated line of weakness 58.

The minor flap corresponding to the edge of the panel 48A which is across from the minor flap 56C is effectively defined by a minor flap 56D which is disposed above the transverse edge of the vertical flap 54. The arrangement is such that when the box is erected by folding the end wall panels 42–48 and affixing the vertical flap 54 about the edge 48C of the end panel 48, the minor flap 56D disposed about the vertical flap 54 is effectively positioned about the remote edge of the top closure flap 48A across from flap 56C. The end result of the overall arrangement described above is that at least one opposing pair of the top closure flaps (in this case the flaps 28 and 30) are provided with minor flap portions following erection of the carton.

Figure 3:
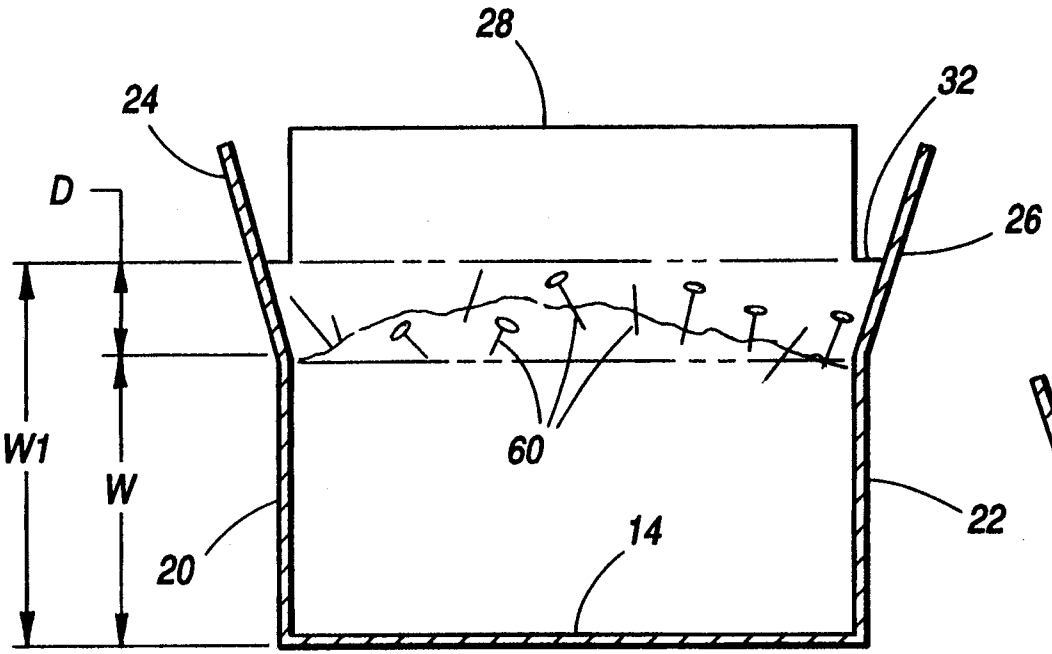
FIG. 3 is a cross-sectional view of an erected open carton formed from the blank shown in FIG. 2 and including nails contained therein.
Figure 5:
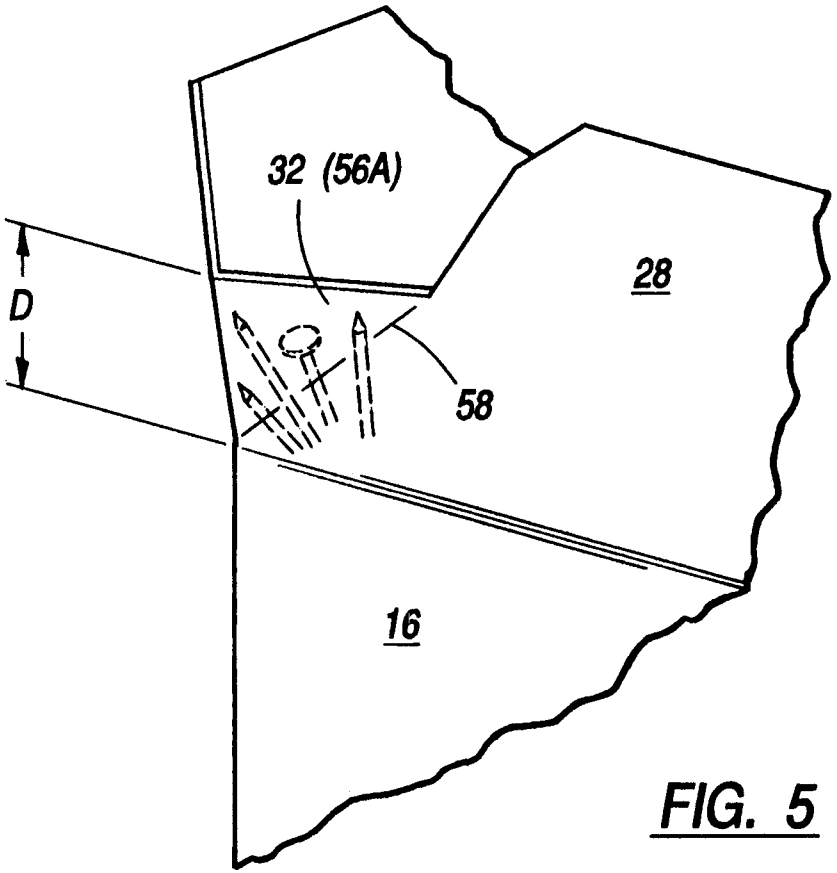
FIG. 5 is a sectional perspective view illustrating the containment effect of the minor flaps according to the present invention.

As best illustrated in FIGS. 3 and 5, the minor flaps 32 extend outwardly and cooperate with adjacent outwardly extending top closure flaps when the carton is in its open position so as to effectively extend the depth W of the carton by a predetermined amount D to an effective depth W1. Accordingly, when the paperboard carton 10 is erected with the top side wall in its open position (as shown in FIG. 1), the top closure flaps 24, 26, 28 and 30 extend outwardly, while at the same time, the minor flaps 32 also extend outwardly and cooperate with adjacent outwardly extending flaps. By extending the effective depth of the carton, the minor flaps 32A allow all of the dumped nails 60, once an erected open carton has been filled, to be below any openings or slots where the nails 60 may be trapped or otherwise lodged (see FIGS. 3 and 5). As a result, therefore, the provision of the minor flaps 32 avoids the existence of corners or slots between adjacent surface edges of the top closure flaps, thereby preventing the trapping of nails and facilitating complete settling of all dumped nails below the effective depth of the carton.

According to a further feature of the present invention, each of the minor flaps 32 is defined in the form of a die cut-out portion which includes a perforated line of weakness 32A (see reference numeral 58 in the carton blank of FIG. 2) angularly disposed in such a way as to permit the minor flaps to be folded inwardly so that no obstruction is provided as the top side of the carton is defined by folding the top closure flaps downwardly into mutual engagement with each other. Consequently, the effective depth of the carton is extended by the illustrated amount D (see FIGS. 3 and 5) only when the carton is filled and closed by folding the top closure flaps.

After the carton has been filled, the top closure flaps are folded down to define the top side of the carton;

simultaneously therewith, the minor flaps also fold inwardly with respect to the associated closure flaps so that the top side of the carton is smoothly defined by the mutual engagement of the adjacent top closure flaps without being obstructed in any way by the minor flaps. It is significant that the only effective depth of the carton upon closure thereof then corresponds to the original carton depth.

According to an illustrative embodiment, the angular lines of weakness 58 through which the minor flaps 32 are connected to the adjacent closure flaps are disposed at 45° with respect to the horizontal edge of the associated closure flaps. Preferably, the angular line of weakness are defined by splitting a central portion thereof and scoring end portions thereof to a predefined depth. In particular, the minor flap scores are perforated and offset by an appropriate depth below the corresponding major flap scores or line of weakness. The arrangement is such that the lines of weakness corresponding to the closure flaps, in combination with the minor flap scores, allow the closure flaps to be folded neatly over the minor flaps at the original effective carton depth. An advantage occurring from this arrangement is that the double folds defined by inter-engagement of the closure and minor flaps effectively reinforce the four top side corners of the paperboard carton according to this invention, thereby securely containing all filled nails within the confines of the carton, as shown in FIG. 7.

I claim:

1. A paperboard carton formed from a uniform continuous paperboard blank for housing nails or sharp projecting objects, the carton comprising:

opposing top and bottom sides and two pairs of opposing side walls, said top side defined by a pair of opposing side closure flaps and a pair of opposing end closure flaps which extend from corresponding edges of said side walls, and wherein said side closure flaps and said end closure flaps (i) extend outwardly beyond a vertical plane of said side walls to define an opening and facilitating filling the carton with nails or sharp objects, and (ii) are placed into mutual engagement when said carton is closed so as to define said top side and contain said nails or sharp objects within said carton, said end closure flaps being provided with minor flaps integral therewith and attached to said side closure flaps adjacent said end closure flaps, said minor flaps extending outwardly and cooperating with said end closure flaps and said side closure flaps which extend outwardly to effectively extend the depth of said carton by a predetermined amount, each of said minor flaps being provided on an end of one of said end closure flaps and connected thereto by means of an angular line of weakness whereby said minor flaps fold inwardly to overly said end closure flaps, when said carton is closed, so that said top side is defined by said mutual engagement of said side closure flaps and said end closure flaps without being obstructed by said minor flaps.

2. The paperboard carton according to claim 1 wherein each of said angular lines of weakness is disposed at 45° with respect to a horizontal edge of a respective one of said end closure flaps.

3. The paperboard carton according to claim 1 wherein each of said angular lines of weakness is defined by splitting a central portion of the line and scoring end portions of the line to a predefined depth.

* * * * *